US006349628B1

(12) United States Patent
Heineken

(10) Patent No.: US 6,349,628 B1
(45) Date of Patent: Feb. 26, 2002

(54) HELIX THRUSTER

(75) Inventor: Clinton B. Heineken, Vacaville, CA (US)

(73) Assignee: Universal Propulsion Company, Inc., Phoenix, AZ (US)

( * ) Notice: Subject to any disclaimer, the term of this patent is extended or adjusted under 35 U.S.C. 154(b) by 0 days.

(21) Appl. No.: 09/480,398

(22) Filed: Jan. 11, 2000

(51) Int. Cl.[7] ..... F15B 13/04

(52) U.S. Cl. ..... 91/32; 92/136; 92/85 B; 244/3.29

(58) Field of Search ..... 92/31, 32, 82, 92/85 R, 85 B, 136; 244/3.27, 3.28, 3.29, 49, 75 R; 60/399

(56) References Cited

U.S. PATENT DOCUMENTS 4,422,366 A * 12/1983 Weyer ..... 92/31

4,745,847 A * 5/1988 Voss ..... 92/31

* cited by examiner

*Primary Examiner*—Edward K. Look
*Assistant Examiner*—Igor Kershteyn
(74) *Attorney, Agent, or Firm*—Flehr Hohbach Test Albritton & Herbert LLP

(57) ABSTRACT

Helical thruster having a housing, a piston movable axially within the housing between retracted and extended positions, and an output member rotatively mounted on the housing. Pressurized fluid is applied to the piston to drive the piston from the retracted position toward the extended position, and the output member rotates as the piston travels toward the extended position. In one disclosed embodiment, the piston is non-rotating, and a helical driving connection between the piston and the output member imparts rotation to the output member as the piston travels toward the extended position. In another disclosed embodiment, the piston rotates as it travels toward the extended position, and the output member rotates with the piston.

14 Claims, 3 Drawing Sheets

HELIX THRUSTER

This invention pertains generally to motion converters and, more particularly, to a helical thruster for converting linear motion to rotary motion.

It is in general an object of the invention to provide a new and improved helical thruster for converting linear motion to rotary motion.

Another object of the invention is to provide a helical thruster of the above character which overcomes the limitations and disadvantages of the prior art.

These and other objects are achieved in accordance with the invention by providing a helical thruster comprising a housing with an axially extending bore, a piston movable axially within the bore between retracted and extended positions, means for applying a pressurized fluid to the piston to move the piston from the retracted position toward the extended position, an output member rotatively mounted on the housing, and a driving connection between the piston and the output member such that the output member rotates as the piston travels from the retracted position to the extended position. In one disclosed embodiment, the piston is non-rotating, and the driving connection is a helical drive which imparts rotation to the output member as the piston travels toward the extended position. In another, disclosed embodiment, the piston rotates as it travels toward the extended position, and the driving connection constrains the output member for rotation with the piston.

Figure 1:
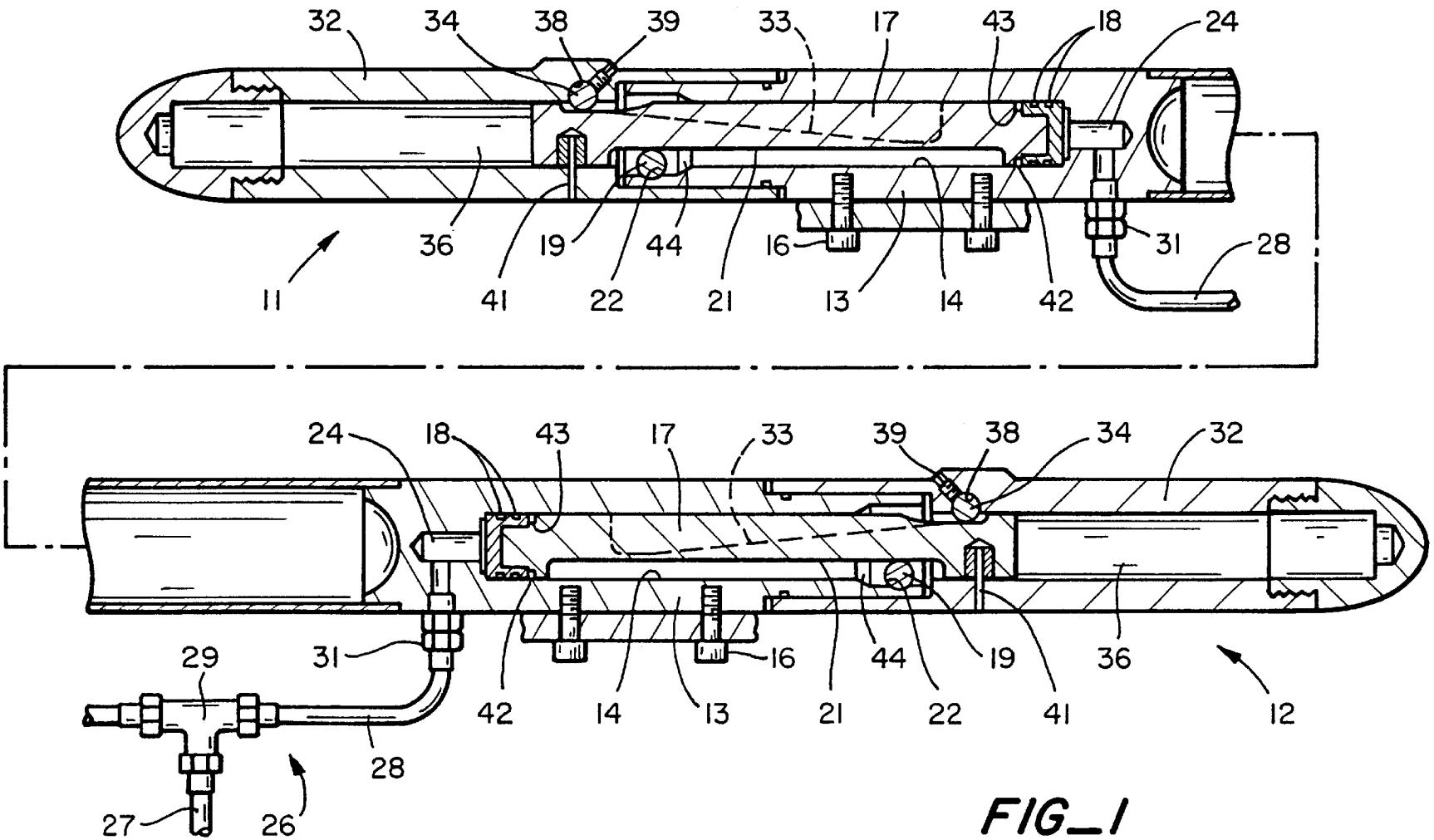
FIG. 1 is a cross-sectional view of one embodiment of a helical thruster incorporating the invention.

In the embodiment of FIG. 1, the helical thruster is illustrated as a dual unit which has two thruster units 11, 12 mounted back-to-back and aligned along a common axis. It will be understood, however, that a similar thruster can be constructed as a single unit, if desired.

Each of the thruster units includes a housing 13 which has an axially extending bore 14, with screws 16 for mounting the housing in a fixed position on a support. Pistons 17 are mounted in the bores for movement between retracted and extended positions, with seals 18 carried by the pistons providing a seal with the walls of the bores. The pistons are constrained against rotation within the housing by pins 19 which engage flat surfaces 21 on the pistons. The pins are mounted in a fixed position in cross-bores 22 in the housings and extend in a direction generally perpendicular to the axis of the main bores. Flat surfaces 21 extend longitudinally of the pistons in a chordal plane parallel to the axis of the pistons.

The pistons are driven from the retracted position toward the extended position by a pressurized fluid which is introduced into chambers 24 at the heads of the bores through lines 26. In the embodiment of FIG. 1, the lines include a supply line 27 which is connected to inlet lines 28 by a T-fitting 29, with the pressurized fluid being introduced into the chambers in a radial direction through fittings 31.

Nose pieces 32 are rotatively mounted on the housings for rotation about the axis of the bores, and are connected to the pistons in such manner that the nose pieces rotate when the pistons travel toward the extended position. In this embodiment, each of the pistons imparts rotation to the nose piece by means of a helical drive surface 33 on the piston and a drive pin or follower 34 on the nose piece. The helical drive surface presents a continuously varying angle of rotation to the follower and twists through an angle of approximately 128 degrees over its length. The drive surfaces on the two pistons are of opposite sense so that the two nose pieces rotate in the same direction as the pistons move away from each other.

The nose pieces have axially extending bores 36 which receive the pistons as they move to their extended position. Drive pins 34 are mounted in cross-bores 38 which intersect the axial bores, with set screws 39 for adjusting the clearances between the drive pins and the drive surfaces.

Means is provided for retaining the pistons in their extended and retracted positions. This means includes shear pins 41 which retain the pistons in the retracted position and lock rings 42 which expand at the end of the piston stroke and hold the pistons in the extended position. The shear pins extend radially between the pistons and the nose housings, and the lock rings are mounted in grooves 43 near the heads of the pistons. The outer ends of bores 14 are formed with sharp tapers or angles 44 which receive the expanded lock rings when the pistons are in the extended position.

In this as well as the other embodiments disclosed herein, the pressurized fluid which drives the pistons can be a compressed gas, which in some instances may be hot or cold, or a can be a suitable liquid.

Operation and use of the embodiment of FIG. 1 is as follows. The thruster housings are mounted on a fixed support, and the nose pieces are connected to the device to be rotated. Until the thrusters are deployed, the pistons are retained in their retracted position by shear pins 41. When pressurized fluid is applied to the pistons, the force on them builds up until it reaches the level required to shear the pins, at which point the pistons start to move forward toward their extended position. As the pistons move, they apply torque to the nose pieces through the continuously variable angles which the helical drive surfaces 33 present to drive pins 34, thereby imparting rotation to the nose pieces and the device to which they are connected. When the pistons reach the end of their travel, lock rings 42 expand into tapered areas 44 to retain the pistons in the extended position.

Figure 2:
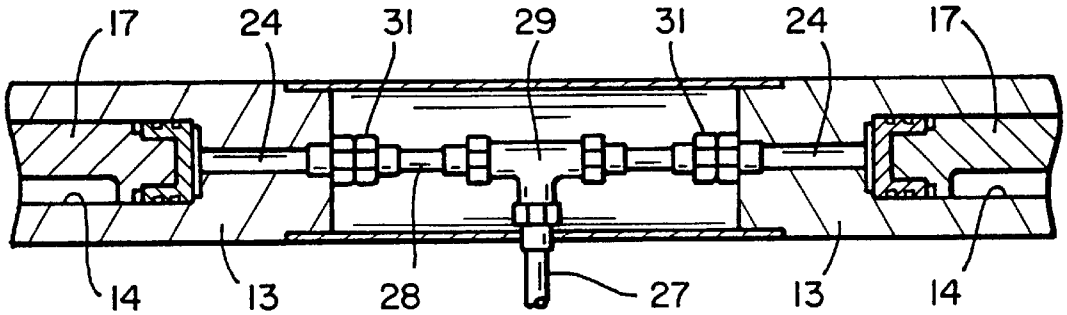
FIG. 2 is a fragmentary cross-sectional view of an alternative arrangement of fluid lines for use in the embodiment of FIG. 1.

FIG. 2 illustrates an alternative embodiment of the lines which supply the pressurized fluid to the chambers in the embodiment of FIG. 1. In this embodiment, the T-fitting 29 is positioned between the two thruster units, fittings 31 are connected to the ends of the housings, and the fluid is introduced into the chambers in an axial direction.

The embodiments of both FIG. 1 and FIG. 2 are useful, for example, in the deployment of missiles where the nose pieces are connected to the fins of the missile. The missile can be carried in an aircraft with the fins retracted, with the fins being extended by firing a gas generator upon deployment of the missile.

Figure 3:
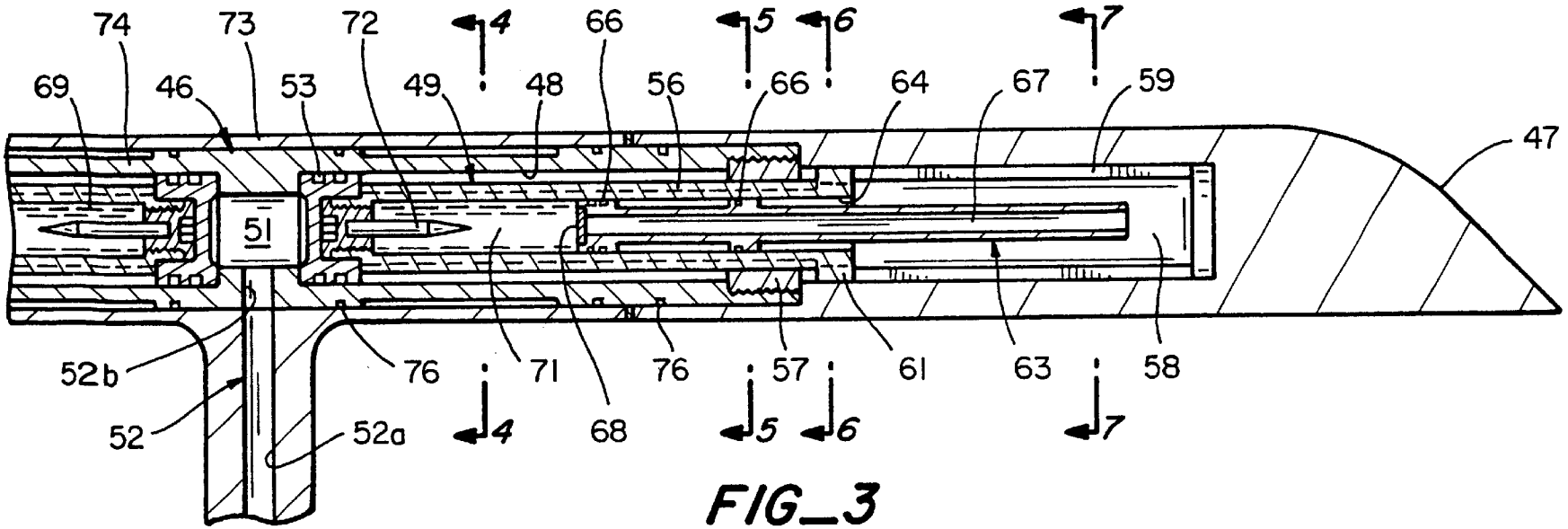
FIG. 3 is a fragmentary cross-sectional view of another embodiment of a helical thruster incorporating the invention.
Figure 4:
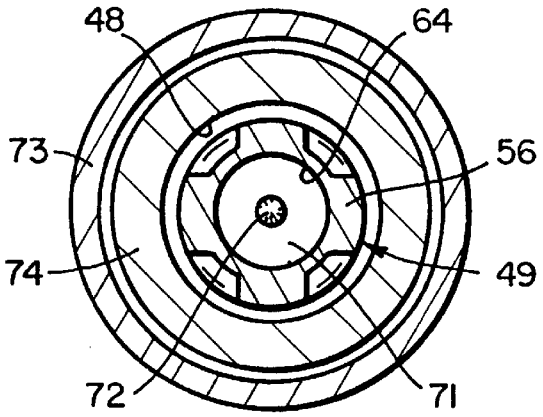
FIGS. 4–7 are enlarged cross-sectional views taken respectively along lines 4—4, 5—5, 6—6 and 7—7 of FIG. 3.
Figure 5:
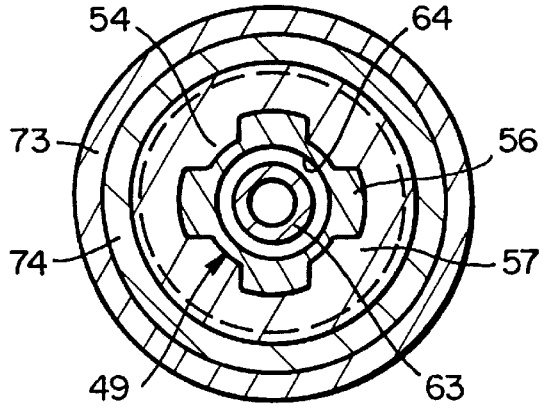
Figure 6:
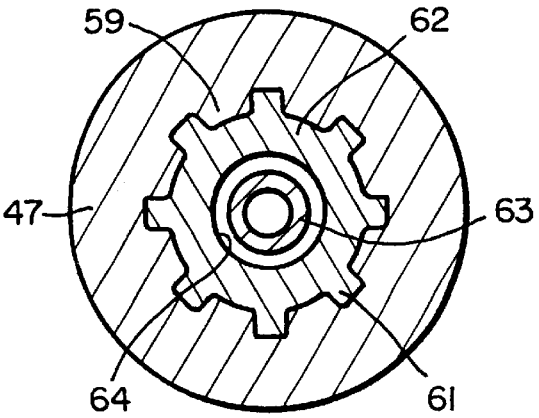
Figure 7:
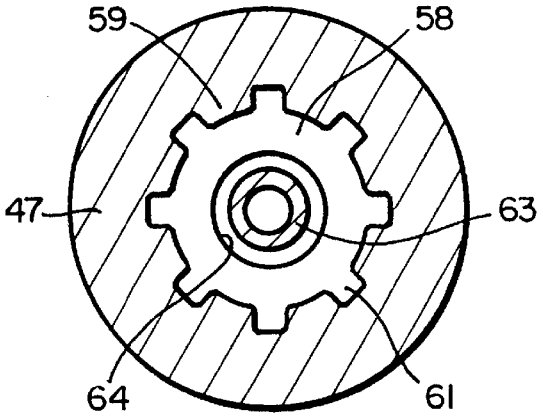

In the embodiment of FIG. 3, the helical thruster includes a stationary mount housing 46 and a pair of nose housings 47 which are rotatively mounted on the mount housing. The mount housing has a pair of aligned axial bores 48 in which drive pistons 49 are mounted for movement between retracted and extended positions. A chamber 51 is formed between the two bores, and pressurized fluid for driving the pistons toward their extended positions is introduced into that chamber through a passageway 52. Seals 53 carried by the heads of the pistons provide a seal with the walls of the bores.

Means is provided for rotating the drive pistons as they travel between the extended and retracted positions. This means includes helical drive splines 54, 56 on the mount housing and on the pistons. Splines 54 are formed on retainers 57 which are threadedly mounted in the outer ends of bores 48, and splines 56 are formed on the bodies of the pistons. Splines 56 extend substantially the entire length of the piston bodies and twist through an angle on the order of 128 degrees. The splines on the two drive pistons are of opposite sense so that the pistons rotate in the same direction as they move away from each other.

Nose housings 47 have axially extending bores 58 in which the drive pistons are received as they travel toward their extended positions, with straight splines 59, 61 providing a driving connection between the pistons and the nose housings. This connection permits the pistons to move axially of the nose housings and constrains the nose housings for rotation with the pistons. Splines 59 are formed inside bores 58, and extend substantially the entire length of the bores. Splines 61 are formed on enlarged hubs 62 at the outer ends of the drive pistons.

Means is provided for snubbing or damping the movement of the drive pistons into the nose housings so that the pistons will not slam against the housings at the end of their stroke. This means includes damping pistons 63 which are mounted in axial bores 64 in drive pistons 49, with rings 66 providing fluid-tight seals between the pistons and the walls of the bores. Axial passageways 67 extend through the damping pistons, with thin disks or diaphragms 68 sealing the inboard ends of the bores at the heads of the damping pistons. Fluid 69 is disposed in the chambers 71 formed by the portion of the bores between the heads of the drive pistons and the damping pistons. Tapered needles 72 extend axially from the inner sides of the heads of the drive pistons into the bores for puncturing the diaphragms of the damping pistons and controlling the flow of fluid from the chambers.

Operation and use of the embodiment of FIG. 3 is as follows. Upon application of pressurized fluid to chamber 51, drive pistons 49 are driven into nose housings 47. As the pistons advance, helical splines 54, 56 cause the pistons to rotate relative to mount housing 46, and this rotation is imparted to the nose housings by straight splines 59, 61.

As the drive pistons start to advance, damping pistons 63 move with them until the outer ends of the damping pistons abut against the end walls of the nose housings. Thereafter, the drive pistons continue to travel, but their movement is resisted by a build up in the pressure of the fluid in chambers 69. As the drive pistons continue to travel, needles 72 puncture diaphragms 68, allowing the fluid to escape into the nose housings at a rate which is controlled by the tapered needles. This permits the drive pistons to finish their stroke at a controlled rate without slamming against the end walls of the nose housings.

In this embodiment, there is no detent or other mechanism to lock the drive pistons in their extended position, and the rotational position of the nose housings can be adjusted by varying the pressure of the drive fluid in chamber 51. This is particularly useful, for example, where the nose housings are connected to a structure such as the fins of a missile. The missile can be carried in an aircraft with the fins retracted, with the fins being extended by firing a gas generator upon deployment of the missile. Thereafter, the path of the missile can be controlled by varying the gas pressure to adjust the fins.

If desired, the lock rings which hold the pistons in the extended position in the embodiment of FIG. 1 can be eliminated, in which case that embodiment can also be used to adjust the position of the fins or other structure connected to the nose housings.

In the embodiment of FIG. 3, means is also included for preventing the thruster from being actuated prematurely in the event that the gas generator or other source of pressurized fluid is accidentally fired. In that regard, the mount housing 46 is formed with an outer section 73 which is rotatively mounted on an inner section 74, with O-rings 76 providing a seal between the two sections. Passageway 52 is formed in two sections 52*a*, 52*b* in the respective housing sections. Prior to deployment, the housing sections are rotated to a position such that the passageway 52*a* in the outer housing is blocked by the wall of the inner housing, and the pressurized fluid will not be applied to chamber 51 even if it is applied to the outer passageway. In the deployment position, the two housing sections are rotated so that the two sections of the passageway are aligned, and the fluid can pass freely from section 52*a* through section 52*b* to chamber 51.

It is apparent from the foregoing that a new and improved helical thruster has been provided. While only certain presently preferred embodiments have been described in detail, as will be apparent to those familiar with the art, certain changes and modifications can be made without departing from the scope of the invention as defined by the following claims.

What is claimed is:

1. In a device for producing rotary motion: a housing having an axially extending bore, a piston movable axially within the bore between a retracted position and an extended position, means for applying a pressurized fluid to the piston to move the piston from the retracted position toward the extended position, means for imparting rotation to the piston as it travels between the retracted position and the extended position, an output member rotatively mounted on the housing, and a driving connection between the piston and the output member such that the output member rotates with the piston.

2. The device of claim 1 wherein the means for imparting rotation to the piston includes helical splines on the housing and on the piston.

3. The device of claim 1 wherein the driving connection includes longitudinally extending splines on the piston and on the output member constraining the output member for rotation with the piston while permitting the piston to move axially relative to the output member.

4. The device of claim 1 including means for damping movement of the piston toward the extended position.

5. The device of claim 4 wherein the means for damping movement of the piston includes a damping piston mounted in an axially extending bore in the drive piston, a body of fluid enclosed within a chamber formed in the last named bore between the heads of the drive piston and the damping piston to provide a driving connection between the two pistons, means for limiting travel of the damping piston toward the extended position, and means carried by the drive piston for puncturing the head of the damping piston when the damping piston stops moving to provide a controlled discharge of the fluid from the chamber which permits the drive piston to continue moving toward the extended position at a controlled rate.

6. The device of claim 5 wherein the means for puncturing the head of the damping piston comprises a tapered needle which forms an opening in the head of the damping piston and thereafter controls the flow of fluid through the opening.

7. In a device for producing rotary motion: a housing having an axially extending bore, a piston movable axially within the bore between a retracted position and an extended position, means for applying a pressurized fluid to the piston to move the piston from the retracted position toward the extended position, helical guide means for imparting rotation to the piston as it travels between the retracted position and the extended position, an output member rotatively mounted on the housing, and a driving connection between the piston and the output member which constrains the output member for rotation with the piston while permitting axial movement of the piston relative to the output member.

8. The device of claim 7 wherein the helical guide means includes helical splines.

9. The device of claim 7 wherein the driving connection includes longitudinally extending splines on the piston and on the output member.

10. The device of claim 7 including means for damping movement of the piston toward the extended position.

11. The device of claim 10 wherein the means for damping movement of the piston includes a damping piston and fluid in an axially extending bore in the drive piston, means for limiting travel of the damping piston toward the extended position, and means carried by the drive piston for puncturing the head of the damping piston when the damping piston stops moving to provide a controlled discharge of the fluid which permits the drive piston to continue moving toward the extended position at a controlled rate.

12. The device of claim 11 wherein the means for puncturing the head of the damping piston comprises a tapered needle which forms an opening in the head of the damping piston and thereafter controls the flow of fluid through the opening.

13. In a device for producing rotary motion: a housing having an axially extending bore, a piston movable axially within the bore between a retracted position and an extended position, means for applying a pressurized fluid to the piston to move the piston from the retracted position toward the extended position, helical splines on the housing and on the piston for imparting rotation to the piston as it travels between the retracted position and the extended position, an output member rotatively mounted on the housing, longitudinally extending splines on the piston and on the output member constraining the output member for rotation with the piston while permitting the piston to move axially relative to the output member, a damping piston and fluid in an axially extending bore in the drive piston, and means for limiting travel of the damping piston toward the extended position, and means carried by one of the pistons for puncturing the head of the other when the damping piston stops moving to provide a controlled discharge of the fluid which permits the drive piston to continue moving toward the extended position at a controlled rate.

14. The device of claim 13 wherein the means for puncturing the head of the piston comprises a tapered needle carried by the head of the drive piston for forming an opening in the head of the damping piston and thereafter controlling the flow of fluid through the opening.

* * * * *